United States Patent [19]

Creagan et al.

[11] Patent Number: 4,875,977

[45] **Date of Patent: * Oct. 24, 1989**

[54] HORIZONTAL TWIN WIRE MACHINE WITH VERTICALLY ADJUSTABLE OPEN ROLL AND DEFLECTOR BLADE

[75] Inventors: Richard W. Creagan, Kirkland; Alan J. Nicol, St. Lazare, both of Canada

[73] Assignee: The Black Clawson Company, Middletown, Ohio

[ * ] Notice: The portion of the term of this patent subsequent to Jul. 30, 2002 has been disclaimed.

[21] Appl. No.: 144,842

[22] Filed: Jan. 15, 1988

Related U.S. Application Data

[63] Continuation-in-part of Ser. No. 39,500, Apr. 17, 1987, Pat. No. 4,724,047.

[51] Int. Cl.[4] ..... D21F 1/36; D21F 1/00

[52] U.S. Cl. ..... 162/300; 162/301; 162/352; 162/DIG. 7

[58] Field of Search ..... 162/300, 301, 348, 303, 162/352, DIG. 7

[56] References Cited

U.S. PATENT DOCUMENTS

| | | | |
|---|---|---|---|
| 2,911,039 | 11/1959 | Hornbostel et al. | 162/DIG. 7 |
| 3,994,774 | 11/1976 | Halme et al. | 162/301 |
| 4,004,968 | 1/1977 | Braun et al. | 162/DIG. 7 |
| 4,146,424 | 3/1979 | Justus | 162/301 |
| 4,447,295 | 5/1984 | Bubik et al. | 162/300 |
| 4,532,008 | 7/1985 | Creagan et al. | 162/301 |
| 4,557,802 | 12/1985 | Waris | 162/301 |
| 4,623,429 | 11/1986 | Tissari | 162/301 |
| 4,686,004 | 8/1987 | Fujiwara | 162/301 |
| 4,724,047 | 2/1988 | Creagan et al. | 162/301 |

FOREIGN PATENT DOCUMENTS 0160615 7/1985 European Pat. Off. .

OTHER PUBLICATIONS

Davies, Rebuilding Existing Paper Machines to Gain Quality and Quantity, P&P Canada, 1985, pp. 55–57.

"Beloit Top Wire Formers" advertising brochure, May 1986.

*Primary Examiner*—Karen Hastings

*Attorney, Agent, or Firm*—Biebel, French & Nauman

[57] ABSTRACT

All of the essential operating parts for adding a top former assembly to a new Fourdrinier paper machine or for converting an existing Fourdrinier paper machine into a top former are carried by a supplemental frame assembly which can be mounted on the main Fourdrinier frame with minimal modification of the latter except the addition of simple parts for securing the supplemental frame assembly on top of the main frame. The primary operating parts of the top wire assembly are a hollow foraminous roll and a top wire deflector which cooperate to collect and deliver liquid expressed through the top wire into a receptacle that is carried by the supplemental frame assembly, and special provision is made for utilizing the top wire deflector to correct for irregularities in the cross machine profile of the paper sheet as it is being formed. Provision is also made for operating the resulting top former in roll former mode, blade former mode, or a combination roll and blade former modes.

19 Claims, 8 Drawing Sheets

HORIZONTAL TWIN WIRE MACHINE WITH VERTICALLY ADJUSTABLE OPEN ROLL AND DEFLECTOR BLADE

CROSS-REFERENCE TO RELATED APPLICATION

This application is a continuation-in-part of our application Ser. No. 39,500, filed Apr. 17, 1987 and issued as Pat. No. 4,724,047 on Feb. 9, 1988.

BACKGROUND OF THE INVENTION

This invention relates generally to paper making machines of the Fourdrinier type wherein the paper is formed on an essentially horizontal run of forming wire traveling from the breast roll to the couch roll.

The invention is more specifically directed to a recent trend in Fourdrinier machines wherein a second wire is mounted on top of the primary wire downstream from the breast roll so that liquid is expressed from the stock on the primary wire through both wires. This type of combined machine is now commonly referred to as a "top former" machine, and as background for the description of the present invention, reference is made to the top former machine shown in Creagan et al U.S. Pat. No. 4,532,008, issued July 30, 1985 to the assignee of the present invention.

SUMMARY OF THE INVENTION

The present invention has a primary object the provision of a top former machine similar to the machine disclosed in the Creagan patent, and capable of producing similarly superior paper free of two sidedness, but which will be simpler than the machine shown in the Creagan patent, which will require even less modification of existing Fourdrinier machine structure, as well as its incorporation into a new paper machine, and which will be capable of greater versatility in operation.

The invention is particularly concerned with problems that have existed in top former machines with respect to the collection and removal of water expressed through the top wire, which necessarily must first be collected within the loop of the top wire. It is also particularly concerned with the provision of a top wire assembly of such construction and mode of operation that its installation requires no major structural changes of an existing Fourdrinier machine.

More specifically, the top former of the present invention comprises an auxiliary frame assembly which can be mounted on top of the main frame of an existing paper machine and the mounting of which requires no substantial modification of the main frame. In addition to the rolls for supporting and driving the secondary wire, this supplemental frame assembly also supports a large roll, preferably hollow, having a foraminous surface which in most instances will be so vertically positioned as to guide the top wire into converging relation with the primary wire.

In addition to this open faced roll, the supplemental frame assembly carries a vertically adjustable wire deflector spaced downstream from the vertical center line of the open faced roll. This top deflector may be so located as to act as a blade forming member, which forces the two wires together at a level below the open faced roll, or it may be so located as to act only as a skimming member with respect to liquid which has been expressed through the top wire as the two wire runs are guided into convergence by the open faced roll. In either case, the top deflector acts in effect as the lower edge of a curved shield which extends upwardly in essentially concentric relation with the open faced roll to define therewith a partial annular space for receiving liquid skimmed from the wires by the top deflector.

This shield may extend beyond the vertical center line of the open faced roll, so that liquid in the space between it and the roll is carried up and over the top of the hollow roll to a position from which it is discharged by centrifugal force into a save-all receptacle mounted in the supplemental frame assembly upstream from the open faced roll. Under some conditions, especially at slow wire speeds, this shield may terminate short of the top of the open faced roll so that the liquid can be discharged into a receptacle on the downstream side of that roll.

A special feature of the former of the invention is that by simple mechanical adjustments, its mode of operation can be varied from a blade or gap type former mode of operation to dandy roll or forming roll type mode or to any combination of such modes of operation.

Another special feature of the former of the invention is that it can be readily adapted to provide for adjusting the profile of the top deflector and thereby improving the profile of the sheet formed thereon by correcting for cross-machine irregularities, particularly such irregularities as are caused by uneven moisture content.

Other features and advantages of structure and mode of operation of the invention will be pointed out in connection with the detailed description of the preferred embodiment which follows below.

DESCRIPTION OF THE PREFERRED EMBODIMENT

Figure 1:
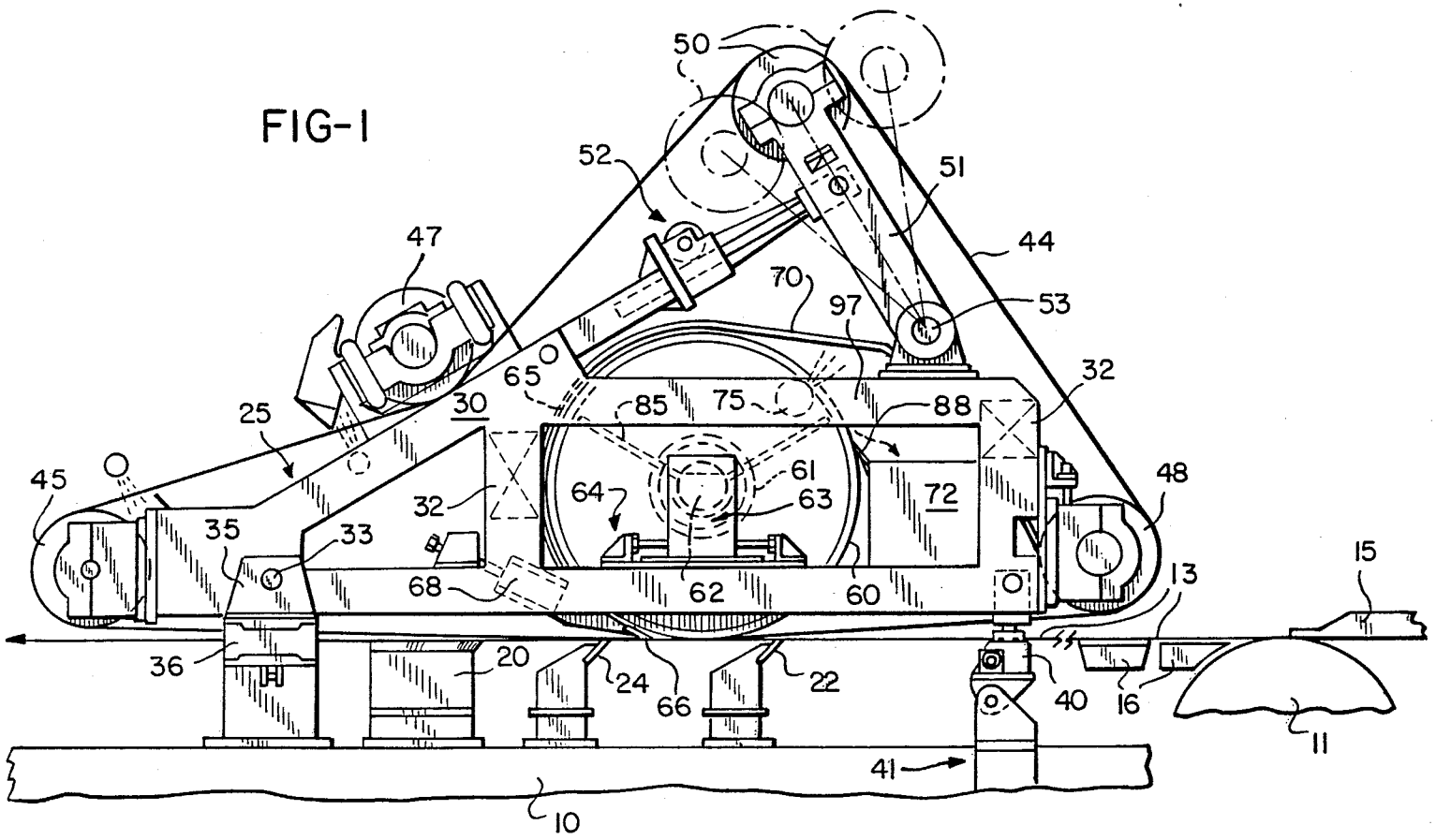
FIG. 1 is a fragmentary side elevation view showing a top former machine in accordance with the invention including an existing Fourdrinier machine.

FIG. 1 shows fragmentarily some of the basic elements of a conventional Fourdrinier paper machine, wherein the main frame includes side beams 10 on which are mounted on the breast roll 11, the couch roll (not shown) and the other rolls for supporting the primary forming wire 13. It is to be understood that while the top formers of the invention are especially adapted for addition to an existing Fourdrinier paper or pulp machine, they are equally adapted for incorporation with a new such machine.

The basic Fourdrinier machine in FIG. 1 may be of any conventional construction. It includes a headbox 15 which delivers a flow of stock at the breast roll 11 onto the upstream end of the horizontal run of wire 13, which may travel first over a series of foil boxes or other dewatering elements 16, one being shown, and then over one or more suction boxes 20 to the couch roll.

There is a space between the last element 16 and the first suction box 20, and in this space are mounted two wire-supporting elements 22 and 24. These elements may be of any conventional type, such as foils or table rolls. In the preferred form of the invention, they will be of the deflector blade type as shown, and it is to be understood that the term "deflector" as used herein is to be interpreted as including all such equivalent elements.

The supplemental frame assembly for supporting the top wire is indicated generally as 25, and it comprises a pair of generally trapezoidal side frames 30 connected together by any suitable arrangement of cross beams, as indicated at 32. The frame assembly 25 is pivotally mounted at one end, shown as its downstream end, on each of the main frame side beams 10, as by means of a pivot pin 33 mounted in a pivot block 35 which is in turn mounted on the front beam 10 by a block 36 that is removable for wire-changing purposes. This pivotal mounting is duplicated at the back of the machine.

At is upstream end, the supplemental frame assembly 25 is supported on the main frame beams 10 by a pair of jack assemblies 40, only the one at the front of the machine being shown, each of which has a pivotal mounting 41 on the adjacent side beam 10 of the main Fourdrinier machine frame. These jack assemblies provide for raising and lowering the entire top former assembly about the pivot pins 33 for purposes explained hereinafter.

The top wire 44 is supported and guided on the frame assembly 25 by four rolls, the roll 45 at the downstream end of the frame assembly being a drive roll shown as driven through a belt or chain by a motor 46 mounted at the back of the frame assembly 25. The roll 47 is a conventional wire guide roll, which the wire 44 may run over or under as shown. The roll 48 supports the wire at the upstream end of frame 25, and the roll 50 is a wire tensioning roll carried by arms 51 pivotally mounted at 53 on frame 25. Each arm 51 is provided with a jack assembly 52 pivotally mounted between it and the supplemental frame 25 for causing roll 50 to swing back and forth as necessary to tension the top wire 44.

A relatively large roll 60 is rotatably mounted inside the frame assembly 30 by bearings 61 on a stationary shaft 62, which is preferably hollow as described hereinafter. The supports 63 for shaft 62 are mounted on each of the side frames 30 for accurately controlled adjusting movement lengthwise of the machine, as by the adjustment mechanism indicated at 64. The roll 60 has a foraminous peripheral surface to provide it with open faced characteristics. For example it may be a hollow roll having an open shell of the type used on conventional dandy rolls, cylinder molds and the like, and similarly provided with a foraminous covering.

Alternatively, the roll 60 may have a foraminous covering over a solid periphery which is grooved or otherwise indented to provide adequate volumetric space to contain all the liquid received through its foraminous covering as it is in contact with top wire 44 and thereby to prevent crushing of the sheet being formed between the two wires. By way of example, tests indicate that a roll 60 having an outer diameter of 42 inches is satisfactory for a substantial range of machine widths, and smaller or larger diameters may be found more suitable for relatively narrow or very wide machines respectively. The location of roll 60 in frame 25 is such that its vertical centerline is between, but not necessarily equidistant, the lower or bottom deflectors 22 and 24.

Figure 2:
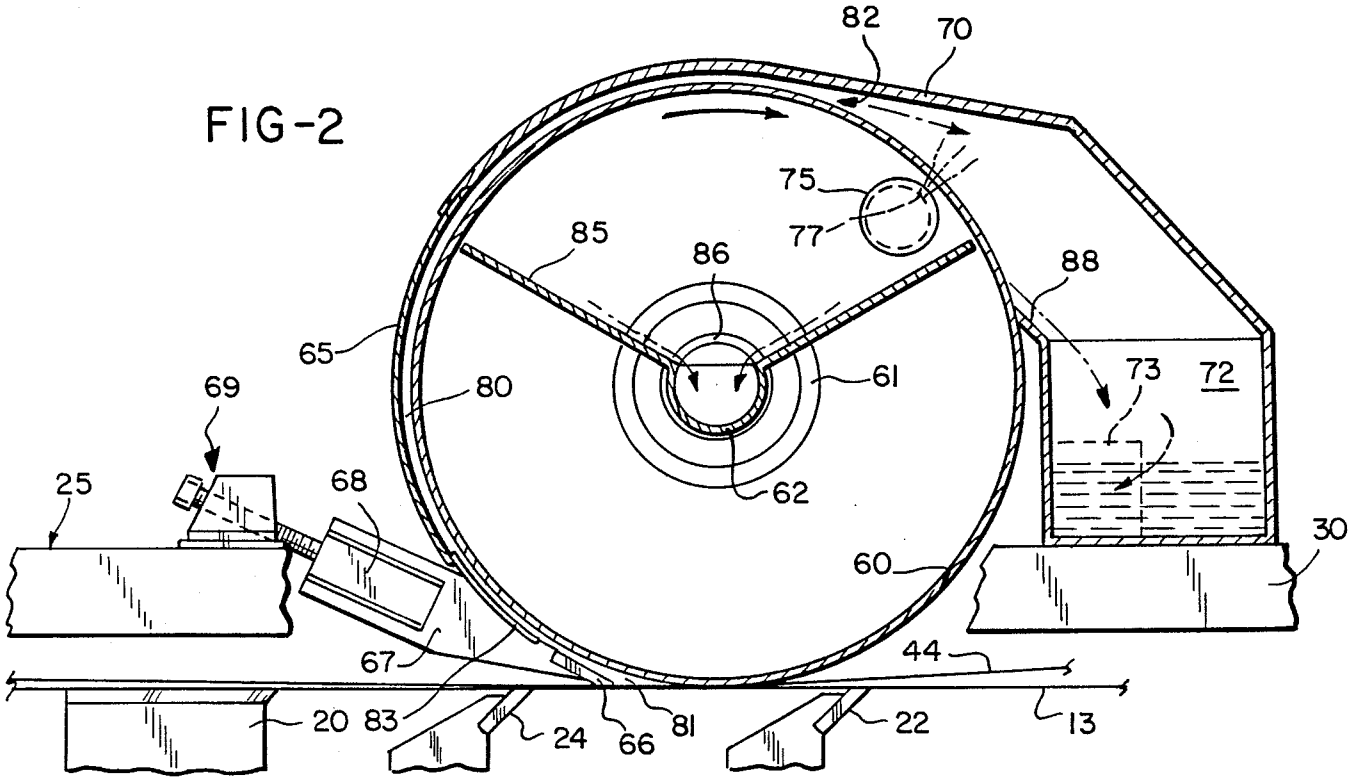
FIG. 2 is an enlarged view of a portion of FIG. 1.

Also mounted inside the frame assembly 30 is a shield member 65 which is curved so that it extends upwardly in substantially concentric relation with roll 60 for approximately 180° from a position on the upstream side of the vertical centerline of roll 60, shown as near 7 o'clock as viewed in FIG. 2, to a position at or on the opposite side of the vertical centerline of roll 60. A top wire deflector 66 is mounted in effectively contiguous relation with the lowermost edge of the shield 65, and it is mounted in position to engage the wire 44 between the vertical centerline of roll 60 and the downstream primary wire deflector 24.

Provision is made for accurately controlled adjustment of deflector 66 to vary the vertical position of its working edge and therefore the extent to which its working edge extends below the horizontal plane defined by the bottom deflectors 22 and 24. For example, the deflector 66 is shown as carried by a series of brackets 67 arranged in spaced relation across the width of the machine, with each of these brackets supported on the frame assembly 25 by a slidable mounting 68 provided with an adjusting jack or screw mechanism 69.

At its upper end, the cylindrically curved shield 65 is continued by an essentially flat top shield 70 which extends tangentially downwardly therefrom at a small angle to the horizontal, and then at a greater angle, into overlying relation with a save-all pan 72 mounted in the frame assembly 30 just upstream from the roll 60. The shield 70 is joined to the upstream wall of the save-all pan 72. White water collected in the pan 72 is discharged through a suitable outlet at one or both sides of the machine, as indicated at 73. In addition, a pipe 75 may be mounted inside the roll 60 and provided with an outwardly facing outlet slot or series of nozzles 77 for discharge of air or water through the surface of roll 60 to expel white water therefrom towards the shield 70 and thus into pan 72.

For preferred operating conditions, the shield 65 should be cylindrically curved about a radius slightly larger than the outer radius of roll 60. Also, the roll 60 should be positioned in substantially concentric relation with the shield 65, by means of the adjustment mechanism 64 as noted above. This arrangement will provide a partial annular channel 80 between the opposed surfaces of roll 60 and shield 65, which will run from an entry throat 81 between the surface of the roll and the top deflector 66 to its enlarged outlet end 82 between the upper surface of roll 60 and the flat shield 70. For convenience of manufacture, the shield 65 may include a skirt portion 83 carried by the deflector-supporting brackets 67.

The radial dimension of channel 80 should be relatively small, and this dimension is related to the speed of the machine as a whole. More specifically, it is important that the radial width of channel 80 be such that there will not be so great a loss of velocity by the water entering this channel to interfere with the delivery of that water to the save-all pan 72. By way of example, tests indicate that this dimension should be no more than about one-half inch, and may be as small as approximately one-sixteenth inch.

An additional liquid collecting pan 85, of generally funnel shape in vertical section lengthwise of the machine direction, is mounted inside the hollow roll 60. This pan 85 is shown as mounted on the stationary shaft 62 with its sides extending toward 10 o'clock and 2 o'clock positions respectively, to collect whatever liquid may fall from the upper portion of the surface of roll 60, as is most probable at relatively low wire speeds.

An opening 86 is provided in the top portion of hollow shaft 62 for receiving such liquid for transmission through the interior of shaft 62 to an outlet at the back of the machine, not shown, leading to the usual white water pit. In addition, a doctor 88 of any suitable material is mounted at the top of the downstream wall of the save-all pan 72 to skim off whatever liquid might adhere to the outer surface of roll 60 and deliver that liquid to the interior of pan 72.

Figure 3:
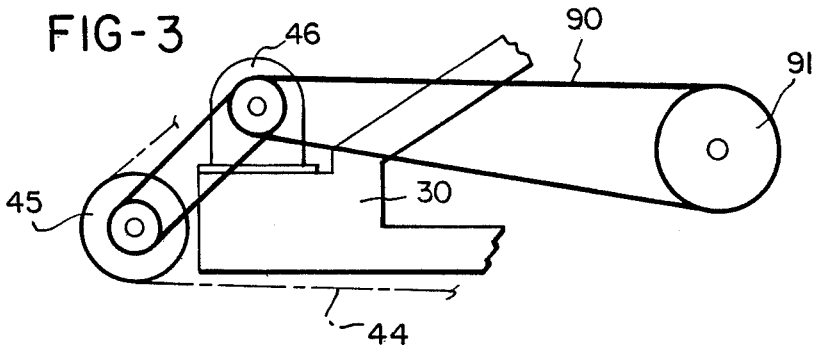
FIG. 3 is a fragmentary view in side elevation indicating the drive arrangement for the top former of FIG. 1.

As pointed out hereinabove, the former of the invention is capable of operation to effect roll type dewatering of the sheet (roll former mode), blade or gap type dewatering (blade former mode), or any combination of both modes as well as standard Fourdrinier mode operation. It should be noted, however, that for all operating conditions wherein the wire 44 is in contact with the open faced roll 60, this roll should be driven at the same surface speed as the top wire 44. Roll 60 may be provided with its own drive, which should be synchronized with the drive for wire 44, or it may be driven by the top wire motor 46 as shown in FIG. 3, through a belt or chain 90 to a relatively large sheave or gear 91 fixed on the back end spider or hub of the roll 60.

Figure 5:
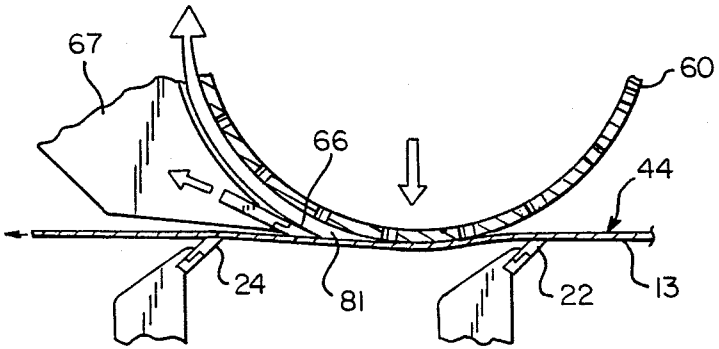
FIGS. 5–8 are somewhat diagrammatic fragmentary views illustrating different modes of operation of the formers of the invention.

Referring to FIG. 5, for roll type dewatering, or roll mode operation, the frame 25 will be adjusted to such vertical position that the roll 60 will guide a run of the top wire 44 downwardly from the upstream wire guide roll 48 into converging relation with the run of primary wire 13 between the bottom wire deflectors 22 and 24. This adjustment should be such that the roll 60 will press the converged wire runs at least slightly below the horizontal level established by the deflectors 22 and 24, the amount of this deflection of the wire runs being based on overall operating conditions and the sheet being produced, as determined by the skill of the operator.

The result of these conditions will be that as the two wire runs converge to the point where they are being forced toward each other by the opposing forces of wire tension and the roll 60, white water will be expressed through the primary wire to the white water pit, and also through the top wire into the interior of roll 60. In this way, the proper conditions for roll mode formation will be created in the wedge zone between the two wire runs which is immediately upstream from the vertical center line of roll 60.

As the wires then travel to the downstream bottom deflector 24, they will be forced together by their relative tensions until they travel over deflector 24, with continued expression of liquid through both wires. After leaving deflector 24, the wire-sheet-wire sandwich travels to the suction box 20, which acts to hold the sheet on the primary wire 13 while the top wire 44 separates therefrom in order to travel upwardly to its drive roll 45.

When the top former is operating in a strictly roll former mode, the top deflector 66 should be set into skimming relation with the upper surface of the top wire 44, as shown in FIG. 5, so that it will continuously skim from the wire the liquid that has been expressed upwardly therethrough from between the two wires by the action of roll 60 in forcing the two wire runs into converging relation. This expressed liquid will initially be carried by its own momentum through the entry throat 81 into the channel 80 between roll 60 and shield 65, and its momentum and the action of roll 60 will cause this liquid to be carried through channel 80 to its upper end 82 through which it is discharged by centrifugal force into the save-all pan 72.

As already noted, in roll mode operation, some liquid will also be forced through the foraminous surface of roll 60 into its interior, and it will similarly be held by centrifugal force, and by the liquid already present in the channel 80, in the radially outer portion of the roll until it is discharged by centrifugal force toward the flat shield 70 after it has passed the 12 o'clock position of roll 60. This discharge of liquid from roll 60 can also be aided by the air or water discharged from the pipe 75 as noted above.

Some of the liquid inside roll 60 may also fall therefrom into the pan 85, and the amount of such inwardly discharged liquid will depend directly upon the rotational speed of roll 60 and the resultant centrifugal force effective on the liquid inside that roll. For example, with the roll 60 having an outer diameter of 42 inches, at wire speeds in the range of 300 to 500 feet per minute, the rotational speed of roll 60 will range from as low as 26 rpm to approximately 44 rpm, and the centrifugal force will be so low that at least a portion of the liquid entering roll 60 will fall into the pan 85. As the wire speed increases, however, the resulting increase in centrifugal force will cause at least most of the liquid to be discharged outwardly of roll 60, into the channel 80 and thence, to the save-all pan 72.

Figure 6:
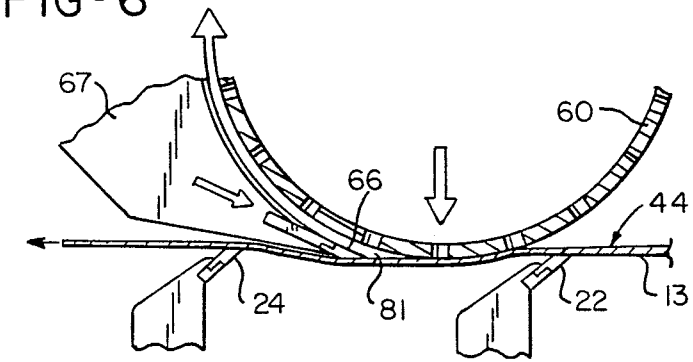

Referring to FIG. 6, in order to operate the former in a combined blade and roll former mode, the assembly 25 may be adjusted downwardly to a position wherein the roll 60 is no more than slightly above, but preferably at or slightly below, the horizontal plane defined by the bottom deflectors 22 and 24. The top deflector 66 is then adjusted downwardly to a position wherein its lower edge is below the horizontal plane tangent to the surface of roll 60.

Under these conditions, the roll formation which takes place in the wedge zone upstream from roll 60 will be supplemented by blade formation as the two wire runs travel downwardly to and around top deflector 66 and then upwardly therefrom to and around the bottom deflector 24. Operation in this combined mode will increase the tension pressure on the two wire runs as they travel from the roll 60 to the deflector 24, with resulting increase in the volume of liquid expressed through the two wires, but this liquid will still be handled in the same way as described above in connection with roll formation.

Figure 7:
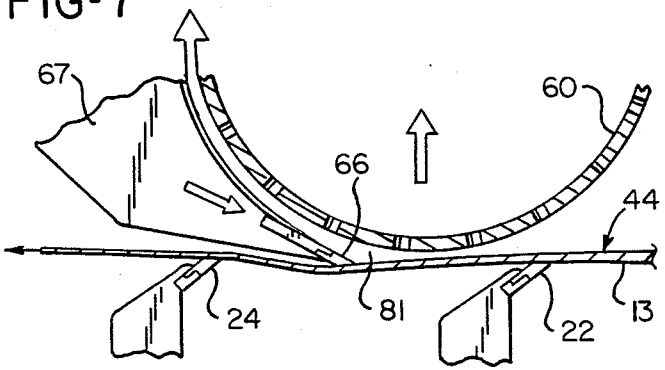

Referring to FIG. 7, in order to operate the former in a blade former mode, the supplemental frame 25 is raised to a level such that the roll 60 is spaced above the horizontal plane established by the deflectors 22 and 24. The top deflector 66 is then adjusted downwardly so that its working lower edge is spaced sufficiently below the surface of roll 60 that it will extend through the horizontal plane defined by the bottom deflector blades 22 and 24. This adjustment may be such that the top wire 44 will wrap a small portion of roll 60 in traveling to the deflector 66, or the wire may have no contact with the roll 60.

Under either of these conditions, formation will take place as the two wire runs converge toward the deflector 66, and travel around the edge of that deflector to and over the downstream lower deflector 24. The result of this arrangement will be true blade former operation, under conditions closely similar to those described in the above Creagan patent, with the two deflectors 66, 22 and 24 operating in conjunction with wire tension as the major liquid-removing elements in the forming zone. As in the other examples, liquid expressed through the primary wire will fall into the white water pit, and liquid expressed through the top wire will be carried through the partial annular space 80 to the save-all pan 72.

Figure 8:
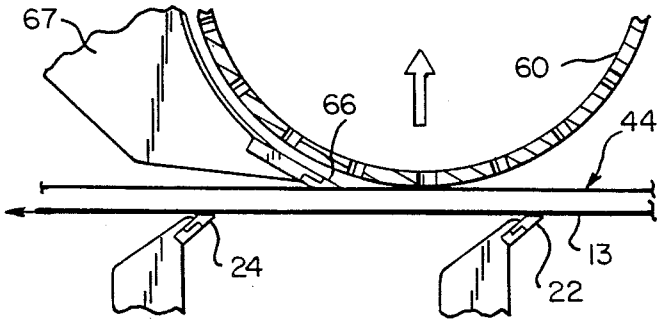

As previously noted, a paper machine incorporating the former of the invention may also readily be operated in standard Fourdrinier mode without any modification of the machine as a whole. More specifically, for standard Fourdrinier operation, as is illustrated in FIG. 8, it is merely necessary to adjust the roll 60 and top deflector 66 upwardly until a sufficient space, e.g., one inch, has been established between the primary wire 13 and top wire 44. In the form of the invention shown in FIG. 1, this adjustment is accomplished by raising the top former assembly around its pivots 33 by means of the jack assemblies 40, with this adjustment being supplemented if necessary by also raising the deflector 66 with respect to roll 60 as already described.

An important operating feature of the former of the invention is provided by the combination of the pivotal mounting of the frame assembly 25 on the main frame and the associated adjusting jacks 40. More specifically, in all operating modes, this combination makes it very simple to adjust the pressure between the wires during and after their convergence as desired to suit different grades of paper and wire speeds. This practical advantage is further contributed to by the provision for effecting vertical adjustment of the top deflector 66 with respect to the frame assembly 25.

It is also important to the versatility of operation of the top former of the invention if the bottom deflectors 22 and 24 are mounted for adjustment in the machine direction over a range which will enable them to be as close to each other as 12 inches or as far from each other as 24 inches. This range is believed not to be critical and may be extended in either direction, depending on test results. For example, the bottom deflectors 22 and 24 may be mounted, as shown, on the frame beams 10 by bolts in a series of selectably usable holes in the beams 10.

In addition to its versatility in operation, the top former of the invention has a variety of practical advantages which derive from its structure. In particular, the supplemental frame assembly 25 is of simple but rugged construction, and what is especially important is that minimal modification of an existing Fourdrinier machine is required in order to equip it with the top former assembly of the invention. More specifically, modification of the existing machine to add the former of FIG. 1 is limited to equipping it with the two lower deflectors 22–24 and the mountings for the pivot blocks 35 and jack assemblies 40.

Figure 4:
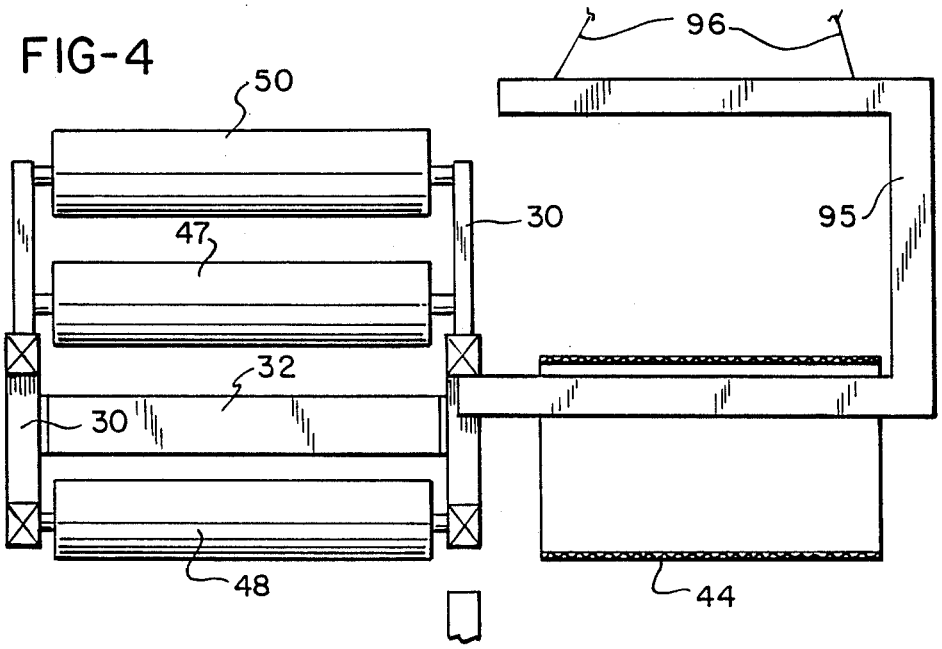
FIG. 4 is a somewhat diagrammatic view looking from left to right in FIG. 1 and illustrating one operation of changing the top wire in the former of FIG. 1.

Another practical advantage which derives from the structure of the former of the invention is the ease with which the wire 44 can be changed. As illustrated in FIG. 4, a new wire 44 may be strung on the lower arm of a generally C-shaped hook 95 suspended from the conventional paper mill crane in the aisle adjacent the machine, as indicated by the cables 96.

In order to string this new wire, it is necessary merely to insert the free end of the lower arm of hook 95 under the upper front beam 97 of the frame 25, and to lift the front side of the frame 25 slightly while removing the block 36 and disconnecting the front jack assembly 40, with the frame assembly 25 still connected to the main Fourdrinier machine frame at the back of the machine. Then with the wire tensioning roll 50 retracted, the new wire can be slipped into position, after which the block 36 is replaced and the hook 95 is removed, and the front jack 40 is reconnected. If the wire 44 runs under the guide roll 47, the guide roll assembly must be temporarily removed, but this is not necessary if the wire runs over the guide roll as shown in FIG. 9.

Figure 9:
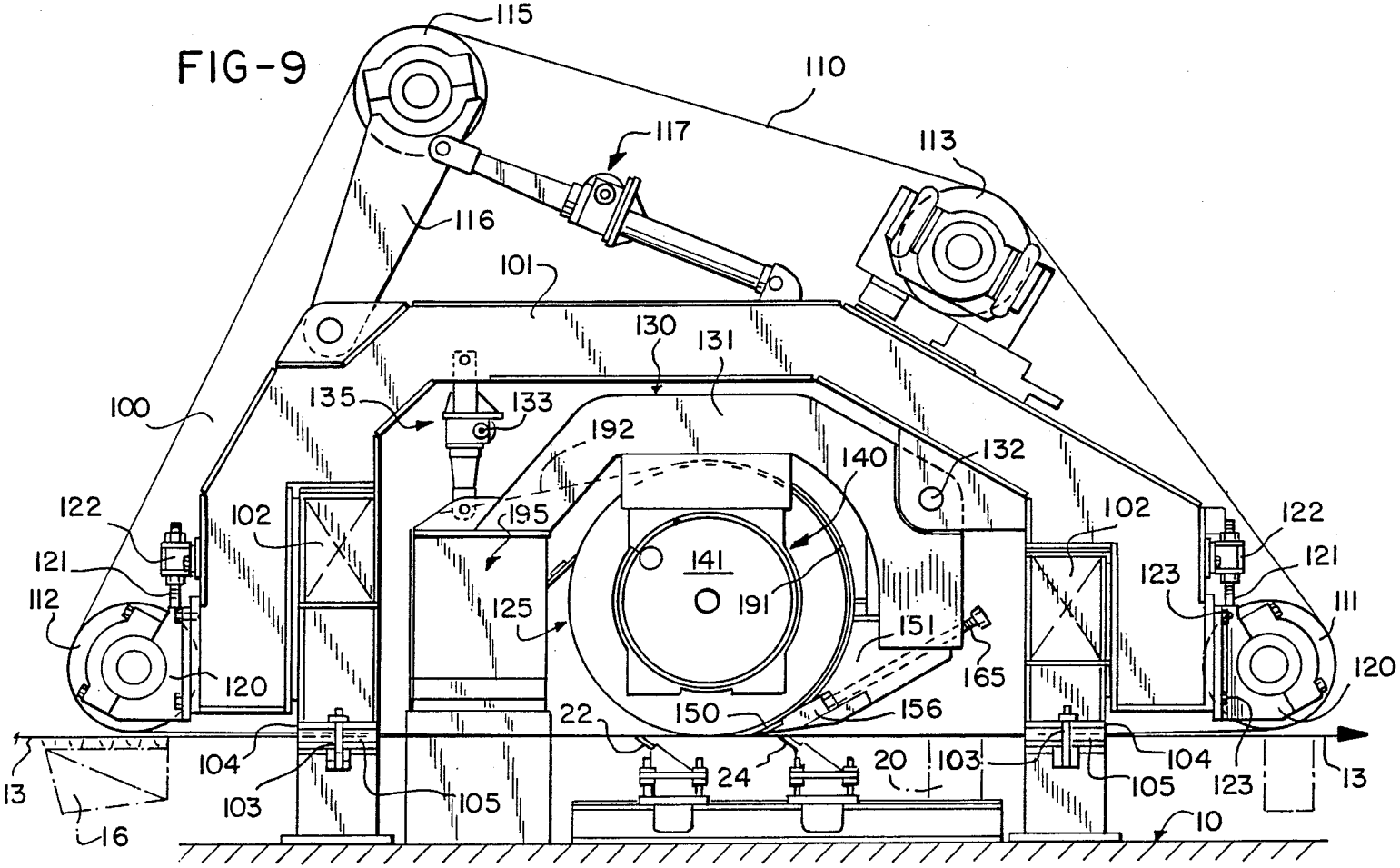
FIG. 9 is a view similar to FIG. 1 showing another top former machine in accordance with the invention.
Figure 10:
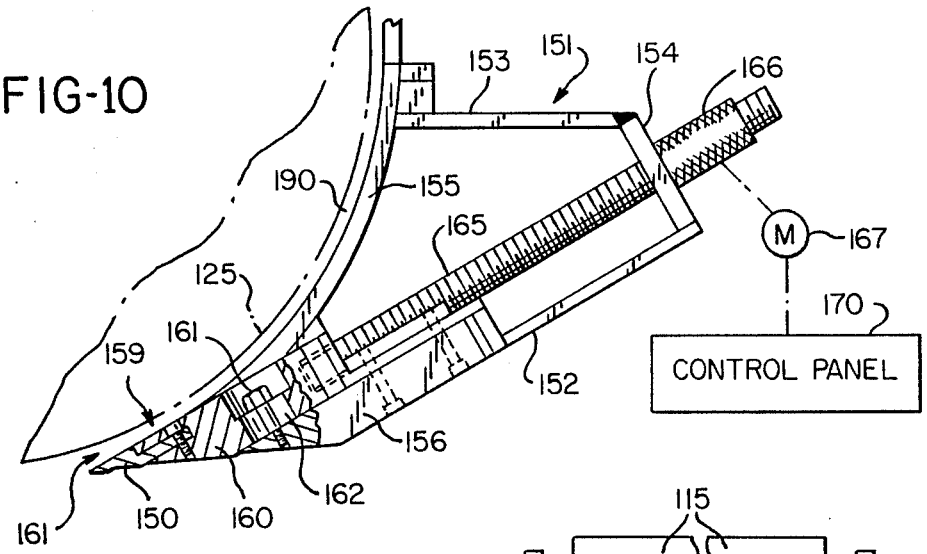
FIG. 10 is a fragment of FIG. 9 on a larger scale.
Figure 11:
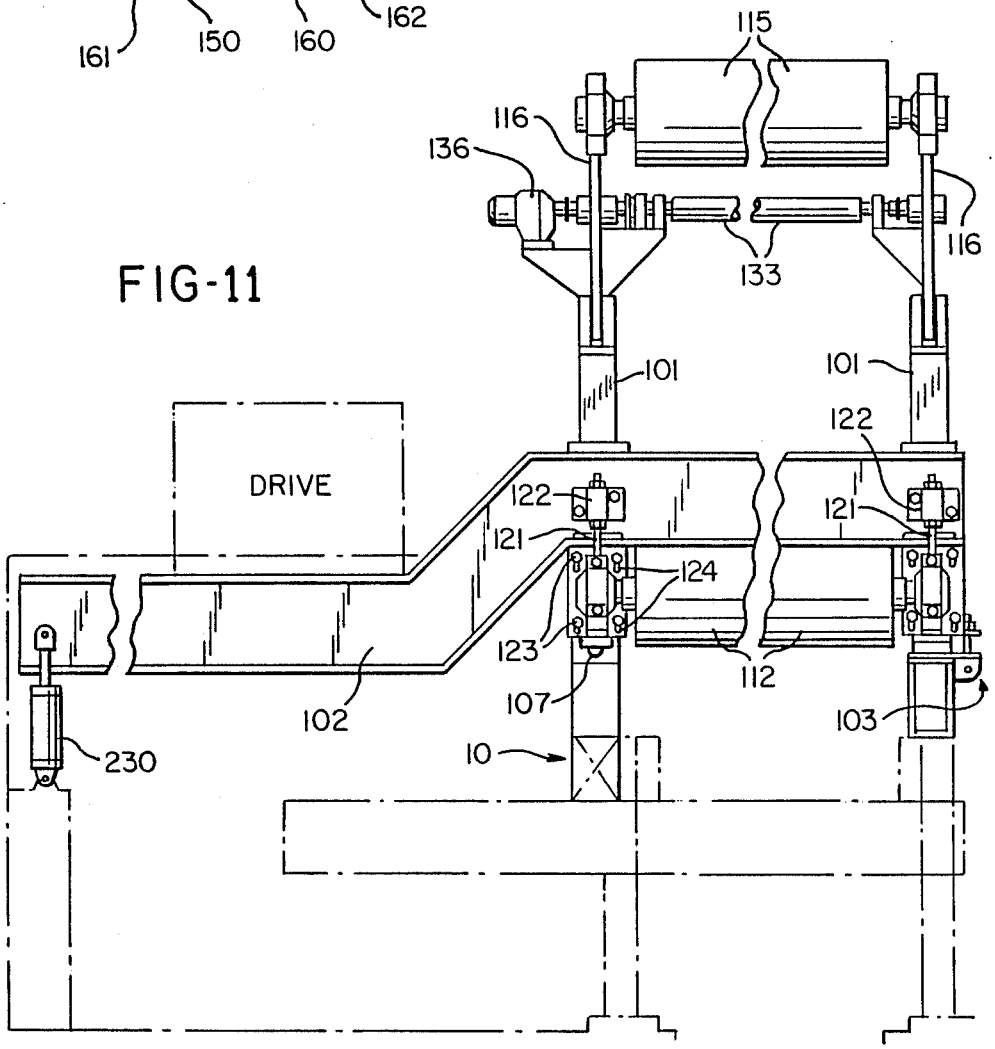
FIG. 11 is a fragmentary view looking from left to right in FIG. 9.

Referring now to FIGS. 9–11, the basic elements of the Fourdrinier paper machine shown in those views bear the same reference characters as in FIGS. 1–2, including the main frame 10, the primary forming wire 13, a foil box 16, the suction box 20 and the primary wire deflectors 22 and 24.

In FIG. 9, the forming run of wire 13 travels from left to right, and the supplemental frame assembly for supporting the top wire is indicated generally at 100. It comprises a pair of arched or inverted generally U-shaped side frames 101 connected together by suitable cross beams including a pair of cantilever beams 102 which extend beyond the back of the machine, as shown in FIG. 11, for use during wire stringing as described below.

In contrast with the pivotal mounting 33 in FIG. 1, the frame assembly 100 is firmly mounted at each end on the main side frame beams 10. At two locations on the front side of the machine, an eyebolt 103 is pivotally mounted on a part of the main frame 10 for releasable clamping engagement with a bracket portion 104 of the frame assembly 100 which rests on a removable block 105. At the backside of the machine, the supplemental frame assembly 100 is secured to the main frame 10 through a pivotal mounting 107 on which the supplemental frame assembly is tilted during wire changing.

The top wire 110 is supported and guided on the frame assembly 100 in essentially the same manner as the top wire 44 in FIG. 1, namely by a downstream roll 111 which is also the drive roll for wire 110, an upstream wire roll 112, a wire guide roll 113, and a wire tensioning roll 115 carried by pivoted arms 116 provided with jack assemblies 117 for moving roll 115 on arms 116 as required to tension the wire 110. The drive for roll 111 may be as shown in FIG. 3, but preferably it is a separate drive appropriately synchronized with the drive for wire drive roll 111. In either case, the drive components may conveniently be mounted on the beams 102 at the back of the machine, as indicated in FIG. 11.

Each of the wire rolls 111 and 112 is mounted for vertical adjustment on frame assembly 100 to vary its vertical spacing above the primary forming wire 13, and thereby the angle at which the bottom run of wire 110 travels towards and away from the primary wire 13. More specifically, the bearing housing 120 at each end of each of these rolls is suspended by adjusting bolts 121 from brackets 122 on each end of frame 100, and it may be clamped in an adjusted position by bolts 123 in suitable vertically extending slots 124 in flange portions of the bearing housing 120.

A relatively large open faced roll 125, which corresponds in purpose and function with the roll 60 in FIGS. 1 and 2 and may be of similar structure, is mounted in the supplemental frame 100 by an auxiliary frame assembly indicated generally at 130. The primary structural members of frame assembly 130 are a pair of arched arms 131, one at each side of the frame 100, each of which has a pivotal mounting 132 on the adjacent side frame 101 on the downstream side of roll 125.

At its upstream end, each arm 131 is connected through a common cross shaft 133 to one of a pair of jack assemblies 135 which are hung from the supplemental frame assembly 100. These jack assemblies 135 provide controlled up and down movement of frame 130 about the pivotal mountings 132, and their common shaft 133 is preferably motor driven, as indicated at 136.

The roll 125 is supported in the frame assembly 130 by having each of the housings 140 for its bearings 141 bolted or otherwise secured in depending relation from the central portion of the adjacent arm 131. Thus pivotal movement of arms 131 about their pivotal mountings 132 will correspondingly raise or lower the roll 125 with respect to the main frame 10 and primary forming wire 13.

The auxiliary frame assembly 130 also supports the top wire deflector 150, which corresponds in position and function with the top wire deflector 66 in FIGS. 1 and 2. A structural member 151 extends the width of the frame 130 and is connected at opposite ends with the downstream ends of the arms 131. This member 151 is fabricated from steel plate to a box-like structure to provide a rigid support for the deflector blade 150.

More specifically, the member 151 includes a bottom portion 152, a top plate 153 and a back plate structure 154. The front of the member 151, which faces the roll 125, is a cylindrically curved plate 155 which corresponds in location and function to the corresponding portion of the shield 60 in FIGS. 1 and 2. A bar 156 extending the full width of the machine is bolted or otherwise secured to the bottom portion of member 151, and this bar projects beyond part 152 and cooperates with the bottom of the shield member 155 to define a slot extending the full width of the machine.

The top deflector blade 150 is clamped at 159 to the edge of a holder bar 160 which extends across the width of the machine and is mounted for controlled sliding movement on the bar 156. More specifically, the bar 160 is secured on the bar 156 by a series of shoulder bolts 161 fitting through slots 162 to provide for sliding movement of bar 160 on the upper surface of bar 155, which is inclined downwardly at an angle of the order of 30° to the horizontal so that sliding movement thereon of the bar 160 causes raising or lowering of the operating level of the wording edge of the deflector 150.

This movement is effected and controlled by individually operable adjusting assemblies located at each end of an at intermediate positions along the structural member 151 so that the profile of the working edge of the deflector 150 can be warped or straightened as desired to control its action on the sheet being formed between the two wires and thereby to equalize the cross machine profile of the sheet. One such adjusting assembly is shown in FIG. 10 as comprising a threaded rod 165 having its lower end fixed to the upper edge of bar 160. The upper end of rod 165 passes freely through a hole in the back plate 154 and receives a nut 166 which is representative of the rotary driving member of any suitable jack assembly for effecting axial movement of rod 165 in either direction.

For a relatively narrow machine, this movement may be effected by manual operation of each nut 166. Preferably, however, each such jack assembly should be operated by an individually controlled stepping motor, as indicated at 167 (FIG. 10), which makes it possible to effect profile adjustment of the deflector blade 150 during operation, as may be desirable to equalize the cross machine profile of the sheets.

In one form of the invention, as illustrated in FIG. 10, all of the series of motors 167 may be controlled individually through a master panel or keyboard 170, by a skilled operator positioned to observe the sheet at an appropriate station downstream from the top former where the profile characteristics of the sheet are readily determined by eye.

For example, whenever this operator observes an irregularity in the sheet indicating the presence of more moisture than in the surrounding areas, he can correct this condition by operating the proper motor or motors 167 to adjust downwardly the position of the working edge of deflector 150 along that portion of the sheet. As this portion of the deflector increasingly penetrates into the converging wires, the corresponding increased pressure on the portion of the sheet which is being formed will cause expression of additional liquid through the top wire until the irregularity has been eliminated.

Figure 12:
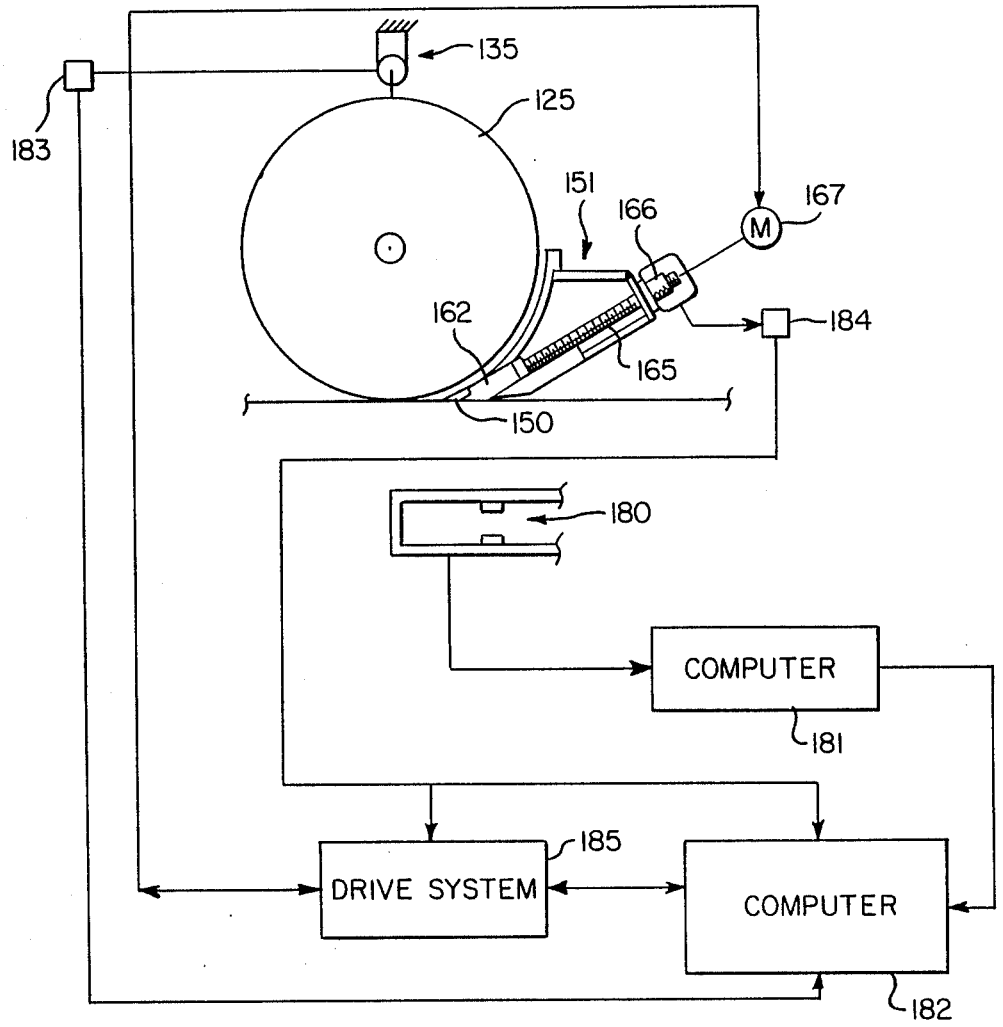
FIG. 12 is a diagrammatic view illustrating a computerized control system incorporated with the top former of FIGS. 9–11.

This type of continuous control of the profile of the forming sheet can also be achieved automatically, by a control system such as illustrated in FIG. 12. Such a control system is obtainable commercially, e.g. from Accuray Corporation, and it commonly includes a cross machine profile scanner 180 which traverses the sheet at an appropriate location where the sheet is unsupported by a felt, e.g. on the upstream side of the size press or at the reel.

In operation, this scanner 180 continuously determines the basis weight profile of the sheet in the cross machine direction and thus detects variations from uniform cross machine basis weight such as are caused by variation in moisture content across the sheet. The scanner feeds a continuous signal into a computer 181 that in turn supplies this information as a signal to a second computer 182, which may be combined with computer 181 and which also continuously receives two other signals. One is the feedback from a vertical position indicator 183 for the open faced roll 125, but because the position of this roll is usually not changed in operation, this signal is normally constant and is therefore used only as a reference.

The other information continuously received by the computer 182 is a signal from each of the adjusting mechanisms 165–166 for the top deflector 150, which signals correspond to the vertically adjusted position of each rod 165. For example, each of the nuts 166 may be provided with means, such as a low voltage differential transformer 184, which senses the angular position of nut 166, and thus the vertical position of its associated rod 165 and the related portion of the deflector 150, and this information is continuously supplied as a signal to computer 182.

The computer 182 is provided with software, of conventional skill of the art design, such that, for example, whenever the computer receives a signal from computer 181 indicating an irregularity caused by the presence of excess moisture in a portion of the sheet, it will respond through the drive system 185 by causing the appropriate one or more of the motors 167 to operate its associated adjusting mechanism 166 to move the associated rod 165 downwardly until the moisture at that location is sufficiently reduced to eliminate any associated irregularity.

Preferably, the software will also include provision for presetting the amount of movement of each such rod 165, as measured by its associated differential transformer 184 and the feedback signal therefrom to computer 182. Similarly, if the scanner 180 and computer 181 determine that the drainage is excessively high in one portion of the sheet, the control system will operate to correct that condition by raising the corresponding portion of the working edge of deflector 150.

It is recognized and understood that control systems as described above have been developed and are in use for controlling the profile of the upper slice lip of a paper machine headbox. However, it is believed that no such control system has previously been used to establish a uniform basis weight profile across a paper sheet as it is being formed on a paper machine by regulating the rate of dewatering in the cross machine direction.

As previously noted, the curved plate component 155 of structural member 151 corresponds in position and function with the lower portion of the shield 65 in FIGS. 1 and 2. This shield member 155 cooperates with the surface of the roll 125 to define a partial annular channel 190 for conducting liquid from the deflector blade 150 up and around the roll 125, in the same manner as the shield 65 as already described. For optimum operating conditions, the shield member 155 should be in accurately concentric relation with the surface of roll 125 and in closely radially spaced relation thereto to provide the channel 190 with a correspondingly narrow radial dimension which may be as low as the order of 1/16 inch.

A further curved shield member 191 forms a continuation of the shield member 155 and is mounted in the auxilliary frame assembly 130 in partially surrounding relation with the upper surface of roll 125. At approximately the 11:00 o'clock position on roll 125 as viewed in FIG. 9, an extension 192 of shield 191 diverges from the roll to direct the liquid into the save-all pan 195, which corresponds to the save-all pan 72 in FIGS. 1 and 2 and is mounted in amy suitable way in the frame assembly 100.

Figure 13:
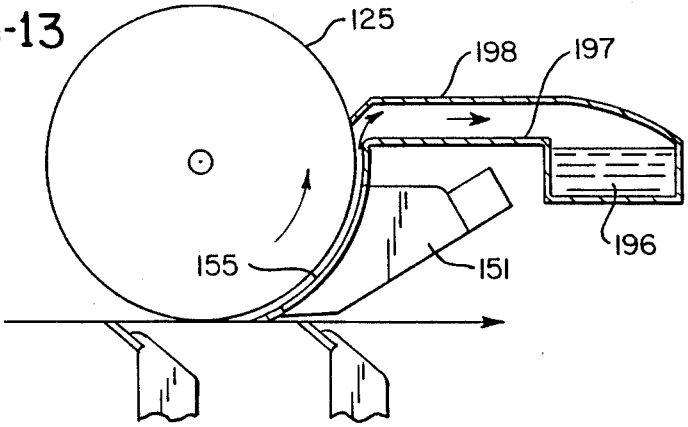
FIG. 13 and 14 are diagrammatic views illustrating alternative structural arrangements for handling the liquid expressed through the top wire in the former of the invention.

This arrangement of shield member 155 and its extensions 191–192 provides highly effective handling of the liquid expressed through the top wire 44 under a wide range of operating speeds for the paper machine. However, at relatively low speeds, the momentum and centrifugal force in channel 190 may not be sufficient to carry the liquid all the way upwardly and around the roll 125. For relatively slow wire speed machines, it is preferable to use a modified liquid collecting assembly as shown in FIG. 13. Such an arrangement includes a save-all pan 196 mounted in the frame assembly 100 on the downstream side of roll 125. Then in place of the shield 191 extending around the roll 125, shield members 197 and 198 define a passage for receiving liquid discharged from channel 190 at the upper end of shield member 155 and direct that liquid into the save-all pan 196.

Figure 14:
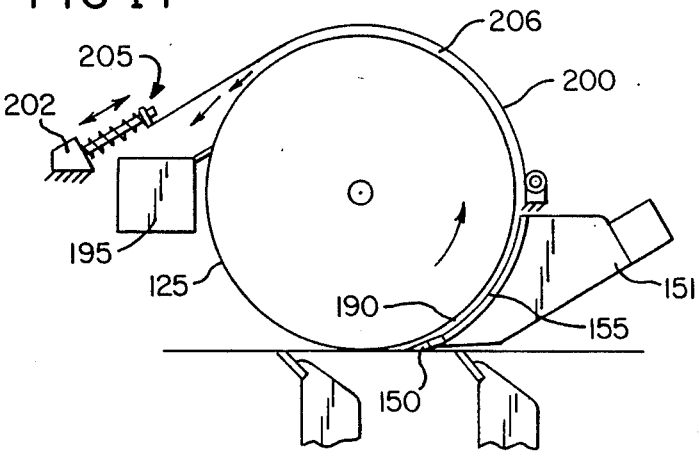

FIG. 14 shows still another shield assembly for use on top formers operating at sufficient speed to provide the liquid expressed through the top wire with sufficient momentum to travel around the top of roll 25. In FIG. 14, the shield 200 is a curtain-like member of sheet plastic or flexible sheet metal which has one end secured to the structural member 151 adjacent the upper edge of the shield member 155.

This curtain shield 200 extends over the top of roll 125, like the shield 65, and has its other end edge attached to the frame assembly 130 by any suitable anchoring structure 202 incorporating biasing means 205 which will provide for movement of the curtain shield 200 away from the surface of roll 125 in response to the flow of water from the channel 190 into the space 206 between curtain shield 200 and the outer surface of roll 125. This shielding arrangement is particularly useful on a paper machine designed to operate over a substantial range of wire speeds, since movement of the curtain shield 200 to increase or decrease the volumetric space of the extension of channel 190 will be in direct response to the volume and flow rate of liquid through that channel.

Figure 15:
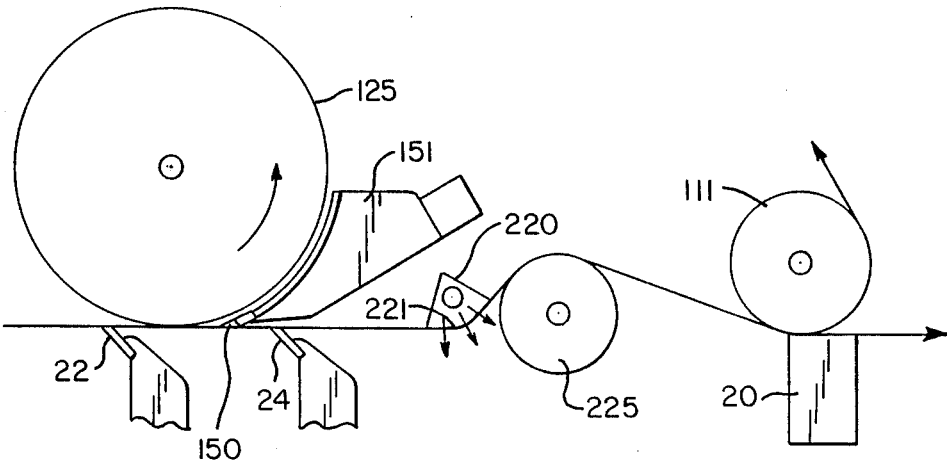
FIG. 15 is a somewhat diagrammatic fragmentary view illustrating a further modification of the former of the invention incorporating additional provisions for effecting dewatering of the paper sheet while it is still sandwiched between the primary and top wires.

FIG. 15 shows a modified form of the invention wherein further provision is made for dewatering of the sheet while it is still sandwiched between the two wires. For this purpose, a blow box or hollow shoe structure 220 is mounted in any suitable way in the frame assembly 100 downstream from the primary wire deflector 24, and this assembly 220 is provided with an arcuately curved and perforate lower face plate 222. A roll 225 is mounted in the main frame 10 downstream from the assembly 220, with its axis and radius being such that it will guide the sandwich of wire-sheet-wire upwardly from the deflector 24 into wrapping contact with the face plate 222, and then downwardly to the top wire drive roll 111.

In operation, the blow box 220 is supplied with high pressure air which will discharge through the perforations in its curved face plate 222 and thereby blow water out of the sheet through the primary wire 13 and down into the white water pit. Tests indicate that this modification of the invention will readily dewater the sheet to a consistency substantially higher than can be obtained by the normal drainage facilities of a Fourdrinier paper machine even when equipped with a conventional top former. Separation of the top wire from the bottom wire and the sheet thereon will still be carried out as already described, with the roll 111 guiding the top wire upwardly as the bottom wire and sheet pass over a suction box 20.

The forms of the invention shown in FIGS. 9–15 offer the same practical advantages in operation as previously described in connection with FIGS. 1 and 2. A further advantage is that with the supplemental frame 100 firmly mounted on the main frame 10, vertical adjusting movement of the roll 125 requires only pivotal movement of its supporting assembly 130 inside the frame 100, and this moving structure is thus very much lighter than the entire supplemental frame assembly in the form of FIG. 1.

Changing of the top wire 110 can be accomplished in substantially the same way as already described in connection with FIGS. 1 and 4. After release of the eyebolts 103, the front side of the frame assembly 100 can be lifted a short distance by pulling down the extended back ends of the cantilever beams 102 by means such as hydraulic cylinders 230, thereby tilting the entire frame assembly 100 about its pivotal mountings 107. Then after the blocks 105 have been temporarily removed, the cantilever beams 102 support the front side of frame 100 a sufficient distance above frame 10 for insertion of a new wire, which can be temporarily supported in conventional manner on a plurality of poles without requiring a hook 95 to support frame assembly 100 as described in connection with FIG. 4.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. Apparatus for forming paper which includes a main frame, means mounted on said frame for supporting a generally horizontal run of a primary endless forming wire, which run has an upstream end and a downstream end, and means for delivering a flow of paper making stock to said upstream end of said wire run for drainage therethrough to form a paper sheet thereon while traveling thereon toward the other end of said run, comprising:

(a) a supplemental frame assembly mounted above said main frame, (b) means including an upstream roll and a downstream roll mounted in spaced relation on said frame assembly above said primary wire run and supporting a run of a top endless forming wire above said primary wire run, (c) a pair of wire deflectors positioned below and in supporting relation with said primary wire run and in spaced relation with each other lengthwise of said main frame wherein they define a gap therebetween across which said primary wire run travels, (d) a third roll having an open face mounted for rotation within the loop of said top wire between said upstream and downstream rolls and with the vertical center line thereof intermediate said pair of primary wire deflectors to receive and guide a run of said top wire directly from said upstream roll, (e) means for driving said top wire and said third roll in the same direction as said primary wire, (f) a top wire deflector blade mounted within said top wire loop and having an edge thereof positioned to engage said top wire at a location within said gap spaced between the vertical center line of said third roll and the downstream one of said pair of primary wire deflectors, (g) means for adjusting the vertical positions of said third roll with respect to said main frame over a range which includes positions of the lower periphery thereof that are below a horizontal plane defined by said primary wire deflectors said adjusting means being structured and arranged such that said third roll will guide said top wire run downwardly from said upstream roll into such converging relation with said primary wire run that said primary and top wire runs define a wedge zone leading to and immediately upstream from the surface of said third roll and having the apex thereof located in said gap, (b) means for adjusting said top wire deflector blade with respect to said main frame and with respect to said third roll over a vertical range which includes positions thereof that are at lower levels than said horizontal plane defined by said primary wire deflectors to vary the pressure exerted by said blade on the converged wires traveling from said third roll to said downstream one of said pair of wire deflectors, (i) a shield mounted in upwardly extending relation from said top wire deflector blade and in facing and enclosing relation with a predetermined portion of said third roll, (j) the relative dimensions and positioning of said shield and said third roll establishing a partial channel therebetween having a lower end thereof positioned to receive liquid directed upwardly from the inner surface of said top wire by said top wire deflector blade whereby such liquid is guided by said shield around said portion of the outer surface of said roll faced by said shield and is discharged centrifugally from an upper end of said channel, and (k) means defining a receptacle for receiving liquid discharged from the upper end of said channel.

2. Apparatus as defined in claim 1 wherein said means for adjusting said third roll comprises means establishing an upper limit position for said lower periphery of said third roll which is above said plane defined by said primary wire deflectors, said top wire deflector blade adjusting means and said third roll adjusting means are structured and arranged such that on or both of said third roll and said top wire deflector blade will guide a run of said top wire from said upstream roll into converging relation with said primary wire run between said pair of deflectors.

3. Apparatus as defined in claim 1 wherein said third roll and said top wire deflector blade are mounted in said supplemental frame assembly.

4. Apparatus as defined in claim 1 further comprising means mounting said upstream wire supporting roll for vertical adjustment on said frame assembly to vary the vertical spacing between said roll and said primary wire.

5. Apparatus as defined in claim 2 further comprising means for mounting said supplemental frame assembly on said main frame.

6. Apparatus as defined in claim 1 further comprising means mounting said pair of deflectors for adjustment with respect to each other lengthwise of said main frame.

7. Apparatus as defined in claim 1 further comprising mounting means for said third roll carried by said supplemental frame assembly and including said means for adjusting the vertical position of said third roll and said means for vertically adjusting said top wire deflector comprises means forming a vertically adjustable mounting connection between said top wire deflector blade and said supplemental frame assembly.

8. Apparatus as defined in claim 1 wherein said means for adjusting said top wire deflector blade comprises an auxiliary frame assembly mounted in said supplemental frame assembly for vertical adjustment with respect to said supplemental frame assembly, means mounting said third roll in said auxiliary frame assembly for vertical adjustment therewith with respect to said supplemental frame assembly, and means forming a vertically adjustable mounting for said top wire deflector blade on said auxiliary frame assembly.

9. Apparatus as defined in claim 8 further comprising means forming a horizontal pivotal connection between said auxiliary frame assembly and said supplemental frame assembly, and means for effecting controlled movement of said auxiliary frame assembly about said pivotal connection.

10. Apparatus as defined in claim 1 further comprising means for effecting vertical adjustment of the cross machine profile of said top wire deflector blade.

11. Apparatus as defined in claim 3 further comprising a plurality of adjustable means for said top wire deflector blade located at spaced positions across the width of said supplemental frame assembly for effecting vertical adjustment of a respective adjacent portion of said top wire deflector blade to vary the cross machine profile of said deflector blade in engagement with said top wire and thereby to change the cross machine profile of the sheet being formed between said wire runs.

12. Apparatus as defined in claim 11 further comprising means for sensing the cross machine profile of the sheet formed between said wire runs, and means including a computer actuated by said sensing means for operating a selected one or more of said plurality of adjustable means.

13. Apparatus as defined in claim 1 wherein said shield comprises a rigid portion in substantially concentric and closely radially spaced relation to said outer surface of said third roll which has an angular dimension equal to a minor fraction of the circumference of said roll, said shield also comprising a flexible portion extending upwardly from said rigid portion in enclosing relation with said open faced roll to a position on the downstream side of the vertical center line of said roll, and means biasing said flexible shield portion toward the outer surface of said roll while providing movement of said flexible shield portion away from said roll in response to flow of liquid therebetween from said partial annular channel.

14. Apparatus as defined in claim 1 further comprising means defining an air chamber supported in said supplemental frame assembly downstream from said top wire deflector blade and inside said top wire, said air chamber having a perforate wall facing said top wire, means for guiding said wire runs into wrapping engagement with said perforate wall, and means for supplying pressure air to said air chamber for discharge through said perforate wall to blow liquid through said primary wire from the sheet between said wires.

15. Apparatus as defined in claim 1 wherein said third roll is hollow, and further comprising pan means within said hollow roll for receiving liquid falling from the upper surface portion of said roll within said roll, and means for conveying liquid from said pan means to a location outside said roll.

16. Apparatus for forming paper, including a main frame, means mounted thereon for supporting a generally horizontal run of a primary endless forming wire having an upstream end and a downstream end, and means for delivering a flow of paper making stock to said upstream end of said wire run for drainage therethrough to form a paper sheet thereon while traveling thereon toward said downstream end of said run, comprising:

(a) a supplemental frame assembly mounted on said main frame and supporting a top endless forming wire above said primary wire to define a two-wire run, (b) a roll mounted for rotation in said frame assembly within the loop of said top wire and with the axis thereof normal to the direction of travel of said wires, (c) said roll being substantially hollow and having a foraminous surface, (d) means for driving said top wire and said hollow roll, (e) a pair of wire deflectors positioned below and in supporting relation with said primary wire run on opposite sides of the vertical center line of said roll along said two-wire run, (f) a top wire deflector blade mounted in said frame assembly at a position spaced between the vertical center line of said roll and the downstream one of said pair of wire deflectors, (g) selective adjusting means connected to said roll and said top wire deflector blade for locating either said roll or said top wire deflector blade in position to guide a run of said top wire into converging relation with said primary wire run between said pair of deflectors, (h) a generally cylindrically curved shield mounted in said frame assembly in upwardly extending relation from said top wire deflector blade and enclosing relation with said roll to a position on the downstream side of the vertical center line of said roll, (i) the relative dimensions and positioning of said shield and said roll establishing a partial annular channel therebetween having a lower end thereof positioned to receive liquid directed upwardly from the inner surface of said top wire by said top wire deflector blade whereby such liquid is guided by said shield around the outer surface of said roll and discharged centrifugally from an upper end of said channel in the upstream direction, and (j) means carried by said auxiliary frame and defining a receptacle on the upstream side of said roll for receiving liquid discharged from said partial annular space.

17. Apparatus as defined in claim 16 wherein said selective adjusting means comprises:

(a) means for adjusting said roll vertically with respect to said main frame to establish the vertical position of said roll with respect to said primary wire run, and (b) means for adjusting said top wire deflector blade vertically on said frame assembly to establish the vertical position of said deflector blade with respect to said top wire run.

18. Apparatus as defined in claim 16 further comprising:

(a) suction box means supporting said primary wire at a position spaced downstream from said pair of deflectors, and (b) means on said supplemental frame assembly for guiding said top wire run upwardly from said suction box means.

19. Apparatus as defined in claim 16 further comprising:

(a) pan means within said hollow roll defining a receptacle for receiving liquid falling from the upper surface portion of said roll within said roll, and (b) means for converging liquid from said pan means to a location outside of said roll.

* * * * *

UNITED STATES PATENT AND TRADEMARK OFFICE

CERTIFICATE OF CORRECTION

PATENT NO. : 4,875,977

DATED : October 24, 1989

INVENTOR(S) : Richard W. Creagan and Alan J. Nicol

It is certified that error appears in the above-identified patent and that said Letters Patent is hereby corrected as shown below:

Column 13, line 64, there should be a comma after "deflectors".

Column 14, line 5, clause "(b)" should be clause --(h)--; line 36, "on" should be --one--; line 59, there should be a comma after "third roll".

Column 16, line 66, "converging" should be --conveying--.

Signed and Sealed this

Sixth Day of November, 1990

*Attest:*

HARRY F. MANBECK, JR.

*Attesting Officer*

*Commissioner of Patents and Trademarks*